US006405446B1

(12) United States Patent
Monroe

(10) Patent No.: US 6,405,446 B1
(45) Date of Patent: Jun. 18, 2002

(54) SPRINKLER REGULATION MARKING TEMPLATE

(76) Inventor: Lance E. Monroe, 55 High St., Higganum, CT (US) 06441

( * ) Notice: Subject to any disclaimer, the term of this patent is extended or adjusted under 35 U.S.C. 154(b) by 13 days.

(21) Appl. No.: 09/684,465

(22) Filed: Oct. 6, 2000

(51) Int. Cl.[7] ..... B43L 7/027
(52) U.S. Cl. ..... 33/563; 33/613; 33/666
(58) Field of Search ..... 33/42, 474, 479, 33/562, 563, 574, 613, 666

(56) References Cited

U.S. PATENT DOCUMENTS

| | | | | | |
|---|---|---|---|---|---|
| 1,545,424 | A | * | 7/1925 | Heimrich | 33/574 |
| 2,470,035 | A | * | 5/1949 | Hudkins | 33/42 |
| 4,129,948 | A | | 12/1978 | Hatter et al. | 33/27.03 |
| 4,220,309 | A | | 9/1980 | Eisen et al. | 33/613 |
| 4,503,624 | A | * | 3/1985 | Whiteford | 33/42 |
| 4,649,652 | A | * | 3/1987 | Dickinson et al. | 33/562 |
| D317,575 | S | | 6/1991 | Ramsey | 33/613 |
| 5,180,135 | A | | 1/1993 | Hindall | 248/544 |
| 5,392,524 | A | | 2/1995 | Hill | 33/563 |
| 5,615,488 | A | | 4/1997 | Brady | 33/562 |
| 6,289,594 | B1 | * | 9/2001 | Wrobbel | 33/474 |

* cited by examiner

*Primary Examiner*—G. Bradley Bennett

(57) ABSTRACT

A sprinkler regulation marking template for facilitating marking of a structure to provide an indication of space which must be left unobstructed to permit proper functioning of sprinklers. The sprinkler regulation marking template includes a main member that has an abutment portion and an extension portion. The abutment portion has a straight edge designed for positioning against a ceiling proximate a sprinkler. The extension portion extends from the abutment portion and includes a plurality of holes. Each of the holes is positioned in spaced relationship to the straight edge such that each hole is positioned for facilitating placing a mark on a structure beneath the ceiling such that the mark is positioned an associated pre-determined distance away from the ceiling for providing a visual indication of a spraying area of the sprinkler for facilitating positioning of objects outside of the spraying area to prevent interference with functioning of the sprinkler.

12 Claims, 2 Drawing Sheets

SPRINKLER REGULATION MARKING TEMPLATE

BACKGROUND OF THE INVENTION

1. Field of the Invention

The present invention relates to regulation templates and more particularly pertains to a new sprinkler regulation marking template for facilitating marking of a structure to provide an indication of space which must be left unobstructed to permit proper functioning of sprinklers.

2. Description of the Prior Art

The use of regulation templates is known in the prior art. More specifically, regulation templates heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. Des. 317,575; U.S. Pat. No. 5,615,488; U.S. Pat. No. 5,392,524; U.S. Pat. No. 4,220,309; U.S. Pat. No. 4,129,948; and U.S. Pat. No. 5,180,135.

While these devices fulfill their respective, particular objectives and requirements, the aforementioned patents do not disclose a new sprinkler regulation marking template. The inventive device includes a main member that has an abutment portion and an extension portion. The abutment portion has a straight edge designed for positioning against a ceiling proximate a sprinkler. The extension portion extends from the abutment portion and includes a plurality of holes. Each of the holes is positioned in spaced relationship to the straight edge such that each hole is positioned for facilitating placing a mark on a structure beneath the ceiling such that the mark is positioned an associated pre-determined distance away from the ceiling for providing a visual indication of a spraying area of the sprinkler for facilitating positioning of objects outside of the spraying area to prevent interference with functioning of the sprinkler.

In these respects, the sprinkler regulation marking template according to the present invention substantially departs from the conventional concepts and designs of the prior art, and in so doing provides an apparatus primarily developed for the purpose of facilitating marking of a structure to provide an indication of space which must be left unobstructed to permit proper functioning of sprinklers.

SUMMARY OF THE INVENTION

In view of the foregoing disadvantages inherent in the known types of regulation templates now present in the prior art, the present invention provides a new sprinkler regulation marking template construction wherein the same can be utilized for facilitating marking of a structure to provide an indication of space which must be left unobstructed to permit proper functioning of sprinklers.

The general purpose of the present invention, which will be described subsequently in greater detail, is to provide a new sprinkler regulation marking template apparatus and method which has many of the advantages of the regulation templates mentioned heretofore and many novel features that result in a new sprinkler regulation marking template which is not anticipated, rendered obvious, suggested, or even implied by any of the prior art regulation templates, either alone or in any combination thereof.

To attain this, the present invention generally comprises a main member that has an abutment portion and an extension portion. The abutment portion has a straight edge designed for positioning against a ceiling proximate a sprinkler. The extension portion extends from the abutment portion and includes a plurality of holes. Each of the holes is positioned in spaced relationship to the straight edge such that each hole is positioned for facilitating placing a mark on a structure beneath the ceiling such that the mark is positioned an associated pre-determined distance away from the ceiling for providing a visual indication of a spraying area of the sprinkler for facilitating positioning of objects outside of the spraying area to prevent interference with functioning of the sprinkler.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be. utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sprinkler regulation marking template apparatus and method which has many of the advantages of the regulation templates mentioned heretofore and many novel features that result in a new sprinkler regulation marking template which is not anticipated, rendered obvious, suggested, or even implied by any of the prior art regulation templates, either alone or in any combination thereof.

It is another object, of the present invention to provide a new sprinkler regulation marking template that may be easily and efficiently manufactured and marketed.

It is a further object of the present invention to provide a new sprinkler regulation marking template that is of a durable and reliable construction.

An even further object of the present invention is to provide a new sprinkler regulation marking template which is susceptible of a low cost of manufacture with regard to both materials and labor, and which accordingly is then susceptible of low prices of sale to the consuming public, thereby making such sprinkler regulation marking template economically available to the buying public.

Still yet another object of the present invention is to provide a new sprinkler regulation marking template which provides in the apparatuses and methods of the prior art some of the advantages thereof, while simultaneously overcoming some of the disadvantages normally associated therewith.

Still another object of the present invention is to provide a new sprinkler regulation marking template for facilitating marking of a structure to provide an indication of space which must be left unobstructed to permit proper functioning of sprinklers.

Yet another object of the present invention is to provide a new sprinkler regulation marking template which includes a main member that has an abutment portion and an extension portion. The abutment portion has a straight edge designed for positioning against a ceiling proximate a sprinkler. The extension portion extends from the abutment portion and includes a plurality of holes. Each of the holes is positioned in spaced relationship to the straight edge such that each hole is positioned for facilitating placing a mark on a structure beneath the ceiling such that the mark is positioned an associated predetermined distance away from the ceiling for providing a visual indication of a spraying area of the sprinkler for facilitating positioning of objects outside of the spraying area to prevent interference with functioning of the sprinkler.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
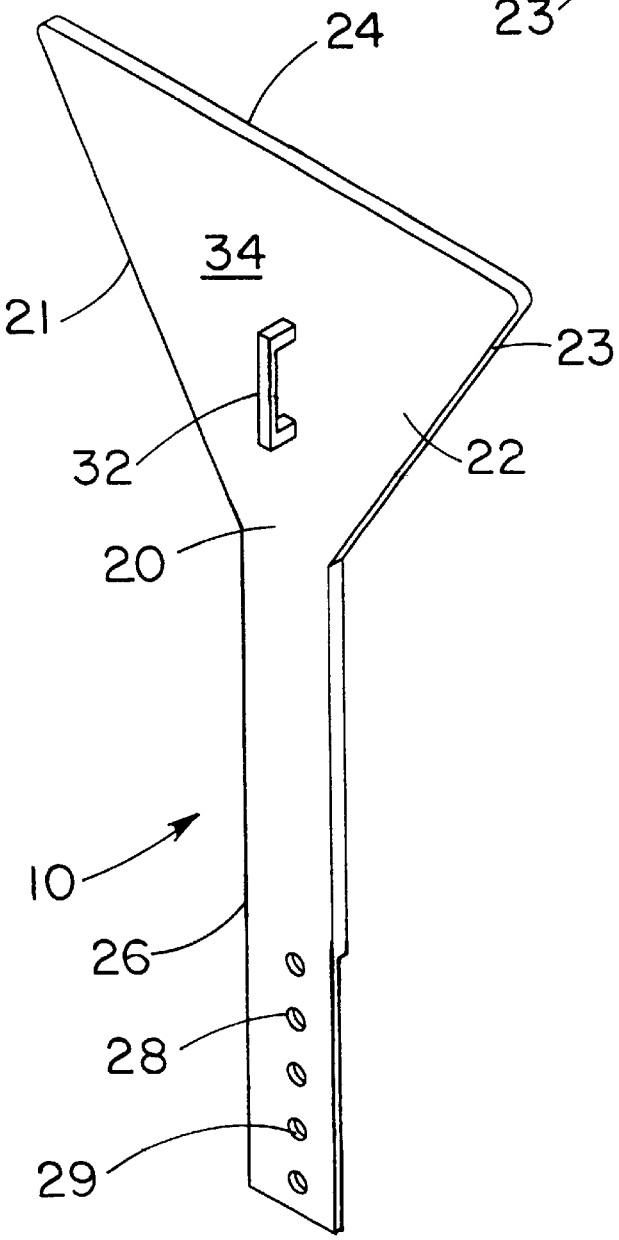
FIG. 1 is a perspective view of a new sprinkler regulation marking template according to the present invention.
Figure 2:
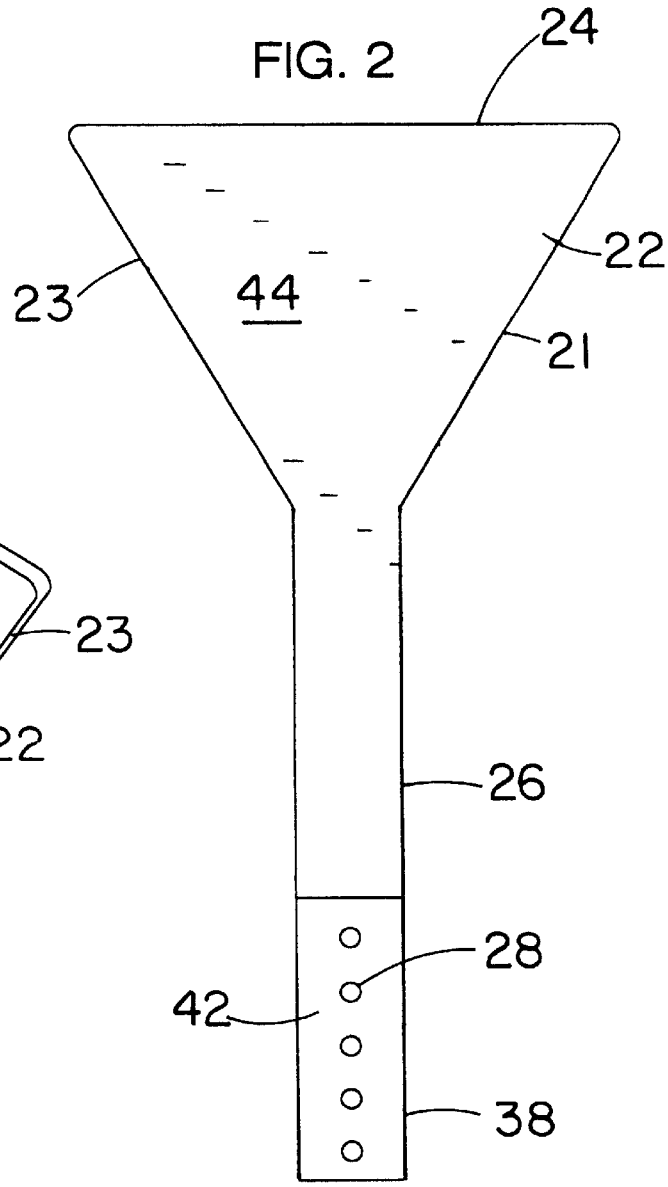
FIG. 2 is a rear view of the present invention.
Figure 3:
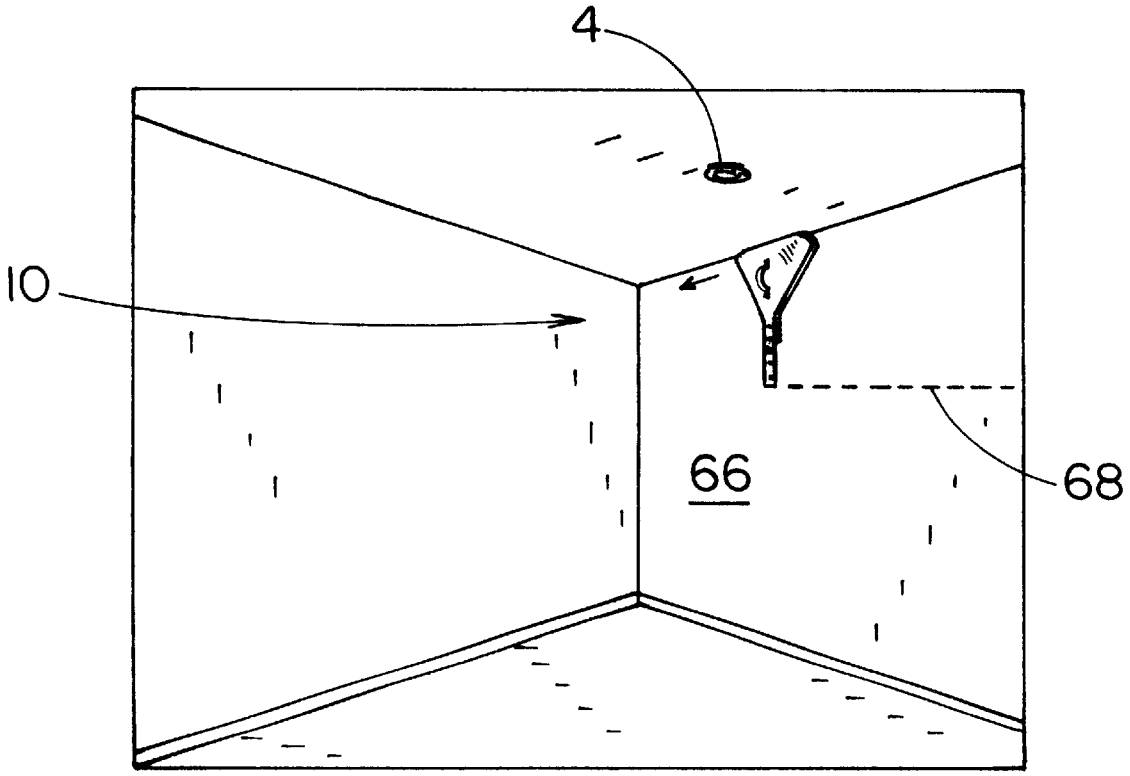
FIG. 3 is a perspective view of the present invention in use.

With reference now to the drawings, and in particular to FIGS. 1 through 3 thereof, a new sprinkler regulation marking template embodying the principles and concepts of the present invention and generally designated by the reference numeral 10 will be described.

As best illustrated in FIGS. 1 through 3, the sprinkler regulation marking template 10 generally comprises a main member 20 includes an abutment portion 22. The abutment portion 22 includes a straight edge 24 designed for positioning against a ceiling 2 proximate a sprinkler 4.

The main member 20 further includes an extension portion 26 extending from the abutment portion 22. The extension portion 26 includes a plurality of holes 28. Each of the holes 28 is positioned in spaced relationship to the straight edge 24. Thus, each hole 28 is designed for facilitating placing a mark 68 on a structure 66 beneath the ceiling 2 such that the mark 68 is positioned an associated predetermined distance away from the ceiling 2. The mark 68 then provides a visual indication of a spraying area of the sprinkler 4 for facilitating positioning of objects outside of the spraying area to prevent interference with functioning of the sprinkler 4.

In an embodiment, the abutment portion 22 is substantially planar and generally trapeziodal in shape such that opposite sides 21 and 23 of the abutment portion 22 taper inwardly extending away from the straight edge 24 for facilitating stable positioning of the straight edge 24 against the ceiling 2.

A handle 32 is coupled to a first face 34 of the abutment portion 22 for facilitating manipulation and positioning of the abutment portion 22.

A first face 36 of the extension portion 26 is coplanar with the first face 34 of the abutment portion 22.

The extension portion 26 includes a distal portion 38 that has a second face 42 substantially parallel to and offset from a second face 44 of the abutment portion 22. Thus, the second face 42 of the distal portion 38 is designed for being positioned in spaced relationship to a structure 66 abutting the second face 44 of the abutment portion 22 when the second face 44 of the abutment portion 22 is positioned against the structure 66.

The holes 28 are positioned to extend through the distal portion 38 of the extension portion 26. Thus, the extension portion 26 is designed for preventing contact of a rim 29 around a selectable one of the holes 28 for marking the structure 66 to prevent smearing of the mark 68 during use.

In an embodiment, the holes 28 are aligned along the extension portion 26 in spaced relationship to each other. The holes 28 extend orthogonally away from the straight edge 24 for facilitating positioning of the mark 68 a selectable distance from the ceiling 2. Thus, the extension portion 26 is designed for marking the structure a pre-determined distance below a lowermost point of sprinklers having various lengths.

In use, the straight edge of the abutment portion is positioned against the ceiling. An appropriate hole is selected depending on local codes requiring a mandatory clear space extending below the lowermost point of a sprinkler and the distance between the lowermost point of the sprinkler and the ceiling. A mark is then made on the structure using the selected hole. Several marks may be made and then joined together if desired to form a line. The marks or line may then be used as a visual indicator to assist in the prevention of positioning or storing objects above the marks or line in violation of the local codes or laws.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in, the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sprinkler regulation marking template comprising:

a main member having an abutment portion, said abutment portion having a straight edge adapted for positioning against a ceiling proximate a sprinkler;

said main member further having an extension portion extending from said abutment portion, said extension portion having a plurality of holes, each of said holes being positioned in spaced relationship to said straight edge whereby each hole is adapted for facilitating placing a mark on a structure beneath the ceiling such that said mark is positioned an associated predetermined distance away from the ceiling for providing a visual indication of a spraying of the spraying area to prevent interference with functioning of the sprinkler;

said extension portion having a distal portion, said distal portion having a face substantially parallel to and offset from a face of said abutment portion whereby said face of said distal portion is adapted for being positioned in spaced relationship to a planar structure abutting said face of said abutment portion when said face of said abutment portion is positioned against the planar structure;

said holes being positioned to extend through said distal portion of said extension portion such that said extension portion is adapted for preventing contact of a rim around a selectable one of said holes for marking the planar structure to prevent smearing of the mark during use.

2. The sprinkler regulation marking template of claim 1, further comprising:

said abutment portion being generally trapeziodal such that opposite sides of said abutment portion taper inwardly extending away from said straight edge for facilitating stable positioning of said straight edge against the ceiling.

3. The sprinkler regulation marking template of claim 1, further comprising:

said face of said abutment portion being a second face; and a handle coupled to a first face of said abutment portion for facilitating manipulation and positioning of said abutment portion.

4. The sprinkler regulation marking template of claim 1, further comprising:

said face of said abutment portion being a second face;

said abutment portion being substantially planar; and a first face of said extension portion being coplanar with a first face of said abutment portion.

5. The sprinkler regulation marking template of claim 1, further comprising:

said holes being aligned along said extension portion in spaced relationship to each other, said holes extending orthogonally away from said straight edge for facilitating positioning of the mark a selectable distance from the ceiling whereby said extension portion is adapted for marking the structure a pre-determined distance below a lowermost point of sprinklers having various lengths.

6. A sprinkler regulation marking template comprising:

a main member having an abutment portion, said abutment portion having a straight edge adapted for positioning against a ceiling proximate a sprinkler;

said main member further having an extension portion extending from said abutment portion, said extension portion having a plurality of holes, each of said holes being positioned in spaced relationship to said straight-edge whereby each hole is adapted for facilitating placing a mark on a structure beneath the ceiling such that said mark is positioned an associated predetermined distance away from the ceiling for providing a visual indication of a spraying area of the sprinkler for facilitating positioning of objects outside of the spraying area to prevent interference with functioning of the sprinkler;

said abutment portion being generally trapeziodal such that opposite sides of said abutment portion taper inwardly extending away from said straight edge for facilitating stable positioning of said straight edge against the ceiling;

a handle coupled to a first face of said abutment portion for facilitating manipulation and. positioning of said abutment portion;

said abutment portion being substantially planar;

a first face of said extension portion being coplanar with said first face of said abutment portion;

said extension portion having a distal portion, said distal portion having a second face substantially parallel to and offset from a second face of said abutment portion whereby said second face of said distal portion is adapted for being positioned in spaced relationship to a planar structure abutting said second face of said abutment portion when said second face of said abutment portion is positioned against the planar structure;

said holes being positioned to extend through said distal portion of said extension portion such that said extension portion is adapted for preventing contact of a rim around a selectable one of said holes for marking the planar structure to prevent smearing of the mark during use; and said holes being aligned along said extension portion in spaced relationship to each other, said holes extending orthogonally away from said straight edge for facilitating positioning of the mark a selectable distance from the ceiling whereby said extension portion is adapted for marking the structure a pre-determined distance below a lowermost point of sprinklers having various lengths.

7. A method for providing a visual indication of a spraying area of a sprinkler for facilitating positioning of objects outside of the spraying area to prevent interference with functioning of the sprinkler, the steps of the method comprising:

providing a main member having an abutment portion, said abutment portion having a straight edge, said main member further having an extension portion extending from said abutment portion, said extension portion having a plurality of holes, each of said holes being positioned in spaced relationship to said straight edge;

positioning said straight edge of said abutment portion against a ceiling proximate a sprinkler; and placing a mark on a structure beneath the ceiling such that said mark is positioned an associated pre-determined distance away from the ceiling whereby a visual indication of a spraying area of the sprinkler for facilitating positioning of objects outside of the spraying area to prevent interference with functioning of the sprinkler is provided.

8. The method of claim 7 wherein said abutment portion is generally trapeziodal such that opposite sides of said abutment portion taper inwardly extending away from said straight edge for facilitating stable positioning of said straight edge against the ceiling.

9. The method of claim 7 wherein said face of said abutment portion is a second face and a handle is coupled to a first face of said abutment portion for facilitating manipulation and positioning of said abutment portion.

10. The method of claim 7 wherein said face of said abutment portion being a second face, said abutment portion is substantially planar, and a first face of said extension portion is coplanar with a first face of said abutment portion.

11. The method of claim 7 wherein said holes are aligned along said extension portion in spaced relationship to each other, said holes extending orthogonally away from said straight edge for facilitating positioning of the mark a selectable distance from the ceiling whereby said extension portion is adapted for marking the structure a predetermined distance below a lowermost point of sprinklers having various lengths.

12. The method of claim 7 wherein said extension portion has a distal portion, said distal portion has a face substantially parallel to and offset from a face of said abutment portion whereby said face of said distal portion is adapted for being positioned in spaced relationship to a planar structure abutting said face of said abutment portion when said face of said abutment portion is positioned against the planar structure; and wherein said holes are positioned to extend through said distal portion of said extension portion such that said extension portion is adapted for preventing contact of a rim around a selectable one of said holes for marking the planar structure to prevent smearing of the mark during use.

* * * * *